US009266667B2

(12) United States Patent
Guoqing et al.

(10) Patent No.: US 9,266,667 B2
(45) Date of Patent: Feb. 23, 2016

(54) PORTABLE AND USER-FRIENDLY MULTI-FUNCTIONAL THERMOS CUP

(71) Applicants: Jiang Guoqing, Zhejiang (CN); James Peng, Fremont, CA (US)

(72) Inventors: Jiang Guoqing, Zhejiang (CN); James Peng, Fremont, CA (US)

(73) Assignee: Photo U.S.A. Corp., Fremont, CA (US)

( * ) Notice: Subject to any disclaimer, the term of this patent is extended or adjusted under 35 U.S.C. 154(b) by 0 days.

(21) Appl. No.: 13/673,044

(22) Filed: Nov. 9, 2012

(65) Prior Publication Data

US 2014/0054301 A1 Feb. 27, 2014

(30) Foreign Application Priority Data

Aug. 24, 2012 (CN) ..... 2012 2 0423515 U

(51) Int. Cl.

| | |
|---|---|
| ***B65D 85/72*** | (2006.01) |
| ***B65D 43/02*** | (2006.01) |
| ***B65D 51/28*** | (2006.01) |
| ***B65D 81/38*** | (2006.01) |

(Continued)

(52) U.S. Cl.

CPC ..... *B65D 85/72* (2013.01); *B65D 43/0229* (2013.01); *B65D 47/0885* (2013.01); *B65D 51/242* (2013.01); *B65D 51/28* (2013.01); *B65D 81/3869* (2013.01); *B65D 2543/00046* (2013.01); *B65D 2543/00092* (2013.01); *B65D 2543/00231* (2013.01); *B65D 2543/00296* (2013.01); *B65D 2543/00435* (2013.01); *B65D 2543/00518* (2013.01); *B65D 2543/00546* (2013.01)

(58) Field of Classification Search

CPC ..... B65D 51/242; B65D 2525/283; B65D 2543/00833; B65D 2543/00851; B65D 2543/00861; B65D 2543/00879; B65D 23/10; B65D 23/108; B65D 25/2835; B65D 25/2855; B65D 25/32; B65D 25/325; A47J 45/065

USPC ..... 220/212.5, 254.1, 254.3, 592.17, 220/592.16, 254.7, 254.8, 259.3, 317–318, 220/846, 710.5, 760, 772, 696, 741, 752, 220/756, 758; 229/404; 215/396–397

See application file for complete search history.

(56) References Cited

U.S. PATENT DOCUMENTS

| | | | | |
|---|---|---|---|---|
| 1,173,730 | A * | 2/1916 | Nelson | 220/212.5 |
| 3,949,897 | A * | 4/1976 | Shaw et al. | 220/231 |
| 4,474,303 | A * | 10/1984 | Maccise | 220/4.27 |

(Continued)

FOREIGN PATENT DOCUMENTS

| | | |
|---|---|---|
| CN | 2364819 Y | 2/2000 |
| CN | 201987170 U | 9/2011 |

OTHER PUBLICATIONS

Photos of Starbuck's thermos and lid.

*Primary Examiner* — Anthony Stashick
*Assistant Examiner* — Robert Poon
(74) *Attorney, Agent, or Firm* — Stetina Brunda Garred & Brucker; Lowell Anderson

(57) ABSTRACT

A portable beverage container and lid has a connecting ring fastened to a rim of the container. A lid has external threads mating with internal threads on the connecting ring. The lid has a top with a drink opening in fluid communication with the container. First and second handles are rotatably connected to opposing sides of the lid to rotate about a common axis, but are offset from that axis. One handle has a plug located and shaped to fit within the drink opening. One or both handles can be rotated upwards to abut each other and carry the container.

18 Claims, 5 Drawing Sheets

(51) Int. Cl.
*B65D 47/08* (2006.01)
*B65D 51/24* (2006.01)

(56) References Cited

U.S. PATENT DOCUMENTS 5,285,917 A * 2/1994 Hoffmann ..... 220/212.5
5,553,731 A 9/1996 Schuyler
5,918,761 A * 7/1999 Wissinger ..... 220/713
6,622,614 B1 9/2003 Smith
D484,743 S 1/2004 Furlong
6,702,138 B1 3/2004 Bielecki et al.
6,726,946 B1 4/2004 Smith
D516,424 S 3/2006 Schweigert et al.
D529,762 S 10/2006 Schweigert et al.
D536,976 S 2/2007 Ciulla et al.
2004/0040962 A1 3/2004 Bielecki et al.
2004/0118846 A1* 6/2004 Merolla ..... 220/254.2
2005/0236442 A1 10/2005 Kratzer
2009/0071969 A1* 3/2009 Lopez ..... 220/592.17
2010/0084403 A1 4/2010 Popish et al.
2012/0031902 A1* 2/2012 Gilbert ..... 220/212.5
2012/0031917 A1 2/2012 Longing

* cited by examiner

PORTABLE AND USER-FRIENDLY MULTI-FUNCTIONAL THERMOS CUP

CROSS-REFERENCE TO RELATED APPLICATIONS

This Application claims priority to Chinese Patent Application No. 201220423515.9 filed on Aug. 24, 2012, entitled Portable and User-Friendly Multi-Functional Thermos Cup", which is incorporated herein by reference in its entirety.

STATEMENT RE: FEDERALLY SPONSORED RESEARCH/DEVELOPMENT

Not applicable

FIELD OF THE TECHNOLOGY

The present invention relates to a portable and user-friendly multi-functional thermos cup, which is a utensil for drinking daily beverages.

BACKGROUND

Cups are needed in daily life. A variety of cups are available in the market, some of which have a lid. One type has a single-layer cup body structure without heat insulation and features that prevent scalding. Another type has a double-layer cup body structure with heat insulation, scald prevention and heat preservation functions. Cups currently available in the market, whether with a single-layer cup body structure or with a double-layer cup body structure, have a common problem. That problem is that during use, a user needs to open the lid before drinking. Thus, such cups have the following disadvantages: when the lid is removed, heat insulation is adversely affected. Moreover, frequent opening of the lid causes fast temperature drop, and meanwhile in public environment, dust in the air is easy to permeate into the cup, which is not clean and sanitary. Some fast food restaurants provide insulated (Styrofoam) cups with plastic caps or lids having small openings in them through which the beverage in the cup can be consumed. This reduces but does not eliminate the above concerns and problems, and allows the hot beverage to pour out the opening if the cup is tipped over or tipped too much.

For the convenience of carrying, some cups in the market are also provided with a handle. The handle usually is of a snap-type, which snaps onto the lid and may fall off while carrying the cup. If boiling water or very hot water is contained inside the cup, there exist potential risks of scalding the user or those nearby, and the risk of damaging the cup as it hits the ground or other objects as it falls.

Moreover, since the cup lid is separable from the cup body, the lid becomes burdensome during drinking and is inconvenient to hold in one's hand. If the lid is placed somewhere while drinking, the lid is often forgotten or even lost. Thus, the cup body and the cup lid are often connected with a tether, which is not elegant in appearance and easy to be damaged as well. In some cups, a plastic fitting is used to connect the cup body with the cup lid. But the fitting does not appear to be in harmony with the cup and is not a part of the cup.

There is thus a need for a lid for a better insulated beverage cup having a drinking opening that is accessible and readily closable. There is a further need for such a lid that is securely fastened to the cup. There is a still further need for a handle that allows the user to securely carry the cup whether the drinking opening is open or closed.

BRIEF SUMMARY

To overcome the disadvantages in prior art, there is provided a portable and user-friendly multi-functional thermos cup. The thermos cup is provided with a double-layer heat insulation cup body. A user can drink beverages contained in the cup without the need to open the lid. A handle for easy handling is combined with a sealed lid to form a harmonious mechanism such that the whole cup lid looks harmonic and beautiful. The cup is convenient to use with significantly improved heat insulation.

There is also provided a portable thermos cup having a cup body and a cup lid. The cup body and the cup lid are connected via thread connection. The cup lid is provided with a sealing ring which is coupled to and sealed with an upper rim of the cup body. The cup lid is provided with a drinking opening, a semicircular ring handle and a semicircular ring lid plug. The semicircular ring handle and the semicircular ring lid plug are pivotally connected with the cup lid, respectively. The semicircular ring lid plug is provided with a plug matching with the shape of the drinking opening to releasably seal the drinking opening.

According to a further embodiment of the present invention, the cup lid is provided with a water outlet, a semicircular ring handle and semicircular ring lid plug. The semicircular ring handle is lifted when carrying, the semicircular ring lid plug is lifted when drinking, and the beverages contained in the cup can be drunk without opening the cup lid. The semicircular ring lid plug prevents the beverages inside the cup from spilling when carrying the cup, and facilitates heat insulation as well. The semicircular ring handle is very firm, guaranteeing safety when carrying the cup. The two semicircular rings form a whole ring when laid flat, which is beautiful and practical.

There is thus advantageously provided a portable beverage container and lid. The container has a container body with a sidewall, a closed bottom and an open top having a rim around the open top. A connecting ring is fastened to the container at the rim. The connecting ring has encircling threads on it and has a rim located to abut the rim on the container. The lid has a lower portion with threads that are configured located to threadingly engage the threads on the connecting ring to releasably fasten the lid to the container. The lid has a flange at an upper end of the threads on the lid with the flange located to abut the rim of the connecting ring. The lid also has a top and a drink opening extending through the lid to provide fluid communication with the container body. First and second handles are rotatably connected to opposing sides of the lid to rotate about a common axis. The handles have a first position abutting the lid and a second position generally parallel to a longitudinal axis of the container and lid during use. The first handle has a plug thereon located and shaped to fit within the drink opening and seal that opening when the first handle is in the first position.

In further variations, the handles have a top side facing along the longitudinal axis when the handles are in the first position. The top sides of the handles are generally parallel to the longitudinal axis when the handles are in the second position and abut each other along a substantial portion of each handle. A substantial portion of each handle or handle length is over 50% of the length of the handle between its ends. Further, the each handle is preferably semicircular in shape and lays against the top of the lid in the first position.

The first position is preferably orthogonal to the longitudinal axis. The drink opening is preferably on the top.

In further variations, the lid has two hinge posts on opposing sides of the lid, preferably on the top of the lid. The semicircular semi-circular handles each has two opposing ends, with the ends of the first handle being on an outer side of each hinge post and the ends of the second handle being on the inner side of each hinge post. Moreover, the opposing ends of each handle are offset from the hinge line but rotating about the hinge line and connected to the hinge post.

In further variations, the lid further includes a drinking recess in the top of the lid, formed inward of the drinking opening and extending toward the container body. The drinking recess is sized to accommodate a user's upper lip when drinking from the drinking opening. The connecting ring's threads are preferably internal threads, but could be external threads. Further, the top of the lid may have an opening with a releasable cover thereon. That opening can providing access to a compartment formed on the underside of the top of the lid. Preferably, the container body is a double wall, stainless steel construction with a space between the two walls to provide thermal insulation.

BRIEF DESCRIPTION OF THE DRAWINGS

These and other advantages and features of the invention will be better appreciated in view of the following drawings and descriptions in which like numbers refer to like parts throughout, and in which.

DETAILED DESCRIPTION

Figure 1:
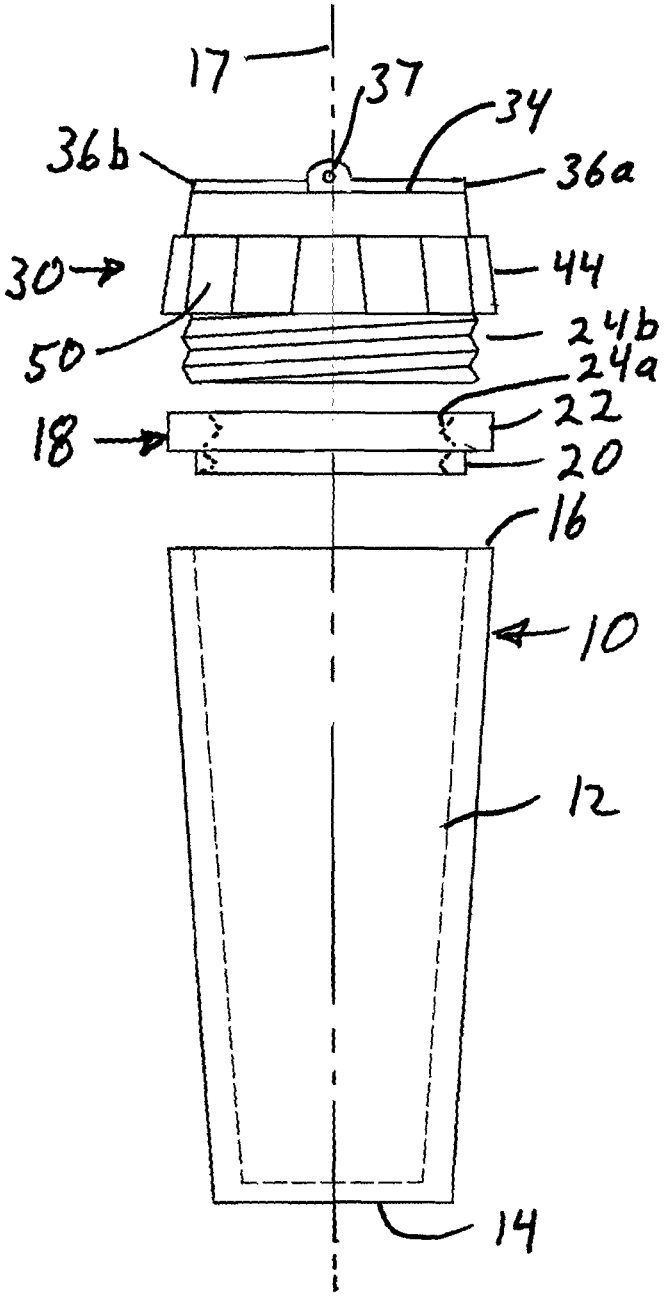
FIG. 1 is an exploded side view of a thermos cup, connector and lid.
Figure 2:
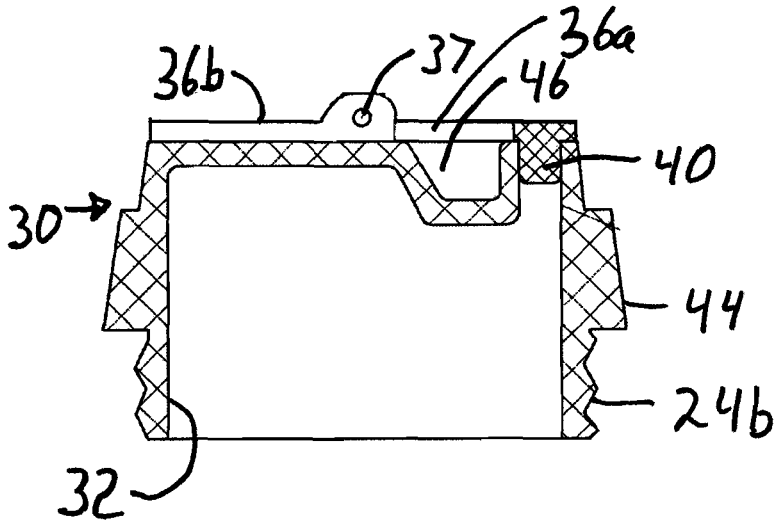
FIG. 2 is a cross-sectional view of a lid and connector of FIG. 1 taken along section 2-2 of FIG. 3.
Figure 8:
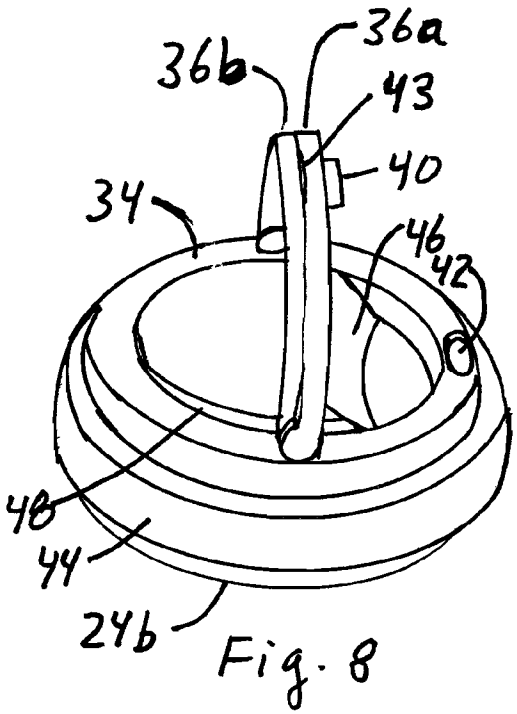
FIG. 8 is a perspective view of the lid and connector of FIG. 1 with the handle and plug in a fully raised position.
Figure 7:
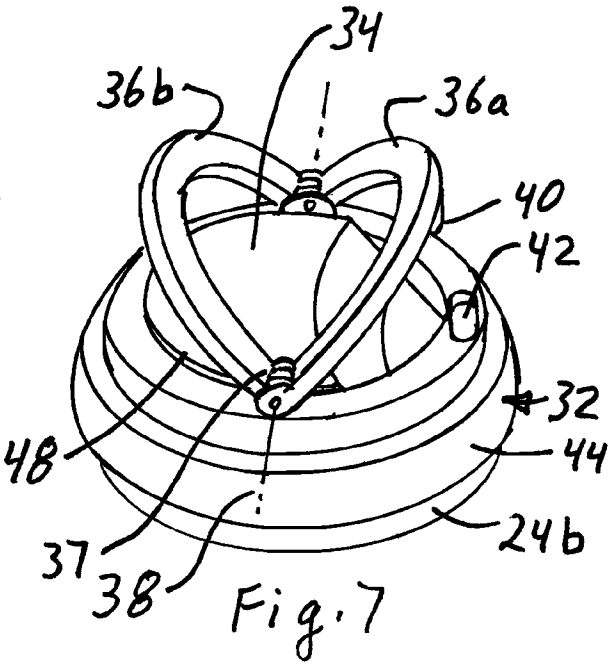
FIG. 7 is a perspective view of the lid and connector of FIG. 1 with the handle and plug in a partially raised position.
Figure 6:
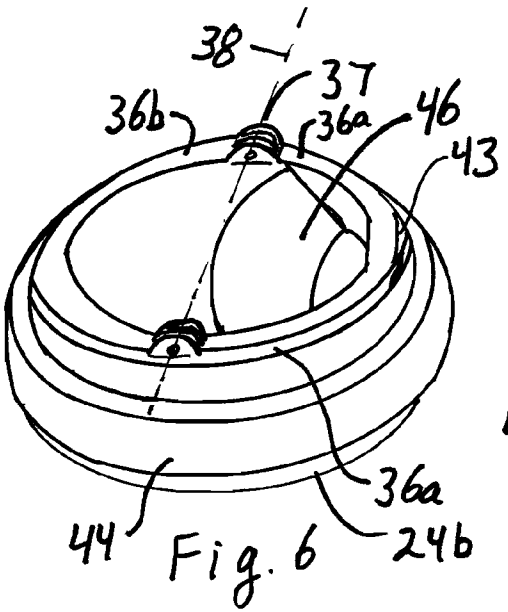
FIG. 6 is a perspective view of the lid and connector of FIG. 1 with the handle and plug abutting the lid.

Referring to FIGS. 1, 7 and 7-8, there is provided a portable and user-friendly, multi-functional beverage container 10, such as a cup. The container 10 has sidewall 12 and a closed bottom 14. The sidewall 12 forms an open top with a rim 16. The sidewall 12 is typically curved to form a cylindrical or slightly conical shaped body for the container 10. As used herein, the relative terms top and bottom or upper and lower refer to the orientation of the cup shown in FIG. 1, with the top being above the bottom 14. The terms inner and outer refer to the position of items relative to the centerline 17.

The rim 16 of the cup 10 is fastened to a connecting ring 18 that encircles the opening in the container 12. The connecting ring advantageously has a short, depending sidewall 20 configured to snuggly fit against the sidewall 12 adjacent the rim 16. The connecting ring 18 also has a radially extending flange 20 abutting distal end of the rim 16. The flange 20 effectively forms a rim of the connecting ring 18 and forms a rim of the container 10 when fastened to the sidewall 12. At least one of the ring's sidewall 20 or flange 22 is fastened to the sidewall 12. Various fastening means may be used, including adhesives, melting, welding and spot welds, rivets, staking or other deformation connections, interference fits, and other fastening mechanisms. The connecting ring 18 is preferably permanently fastened to the rim of the cup 10 to form a fluid tight connection so no beverage inside the cup 10 passes between the connecting ring 18 and the sidewall 12.

The connecting ring 18 also has threads 24*a* on the ring's sidewall 20 located to threadingly engage mating threads 24*b* on lid 30 as described later. The threads 24*a* are internal threads if the sidewall 22 is located on the inside of the cup's sidewall 12, and are external threads if the sidewall 22 is located on the outside of the cup's sidewall 12. FIG. 1 shows internal threads 24*a*.

Removably connected to the top of the container 10 is a lid 30 having sidewall 32 and a closed top 34 which preferably has an upper portion with a circular periphery. Handles 36*a*, 36*b* are rotatably connected to the lid along a common hinge line 38 between hinge posts 37. The two hinge posts 37 are on opposing sides of the lid 30, on the top 34. The two hinge posts 37 are each located between an end of handles 36*a*, 36*b*, with ends of handle 36*a* located outward of the hinge post 37 and ends of handle 36*b* located inward.

Figure 4:
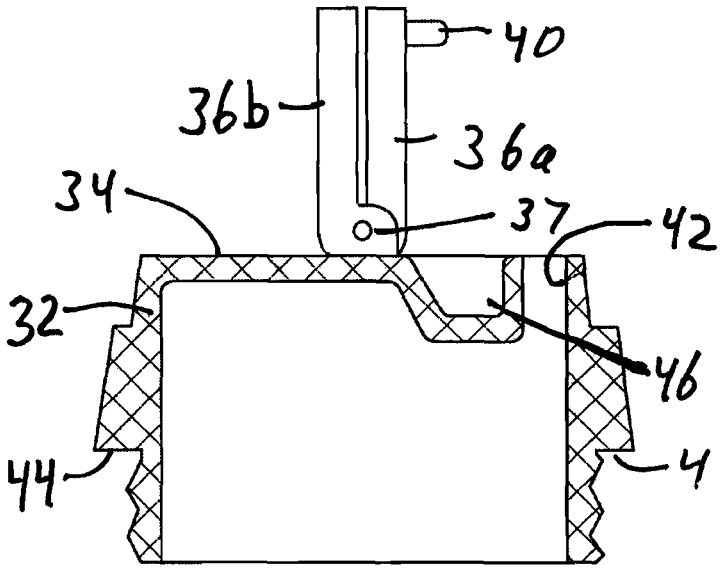
FIG. 4 is a partial sectional view of the lid and connector of FIG. 1, with a side view of a handle in a lifted position and a lid plug in an open position.
Figure 5:
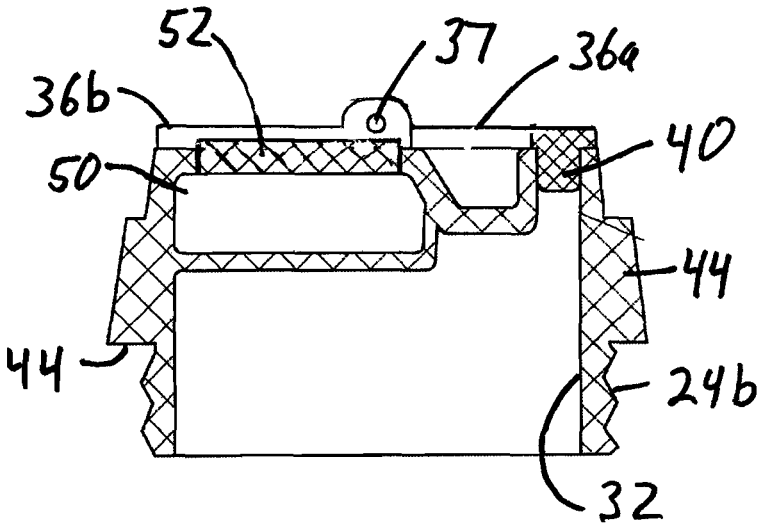
FIG. 5 is a cross-sectional view of a lid and connector with an interlayer chamber.

The body of the handles 36*a*, 36*b* is offset from the hinge line 38 so that when the handles 36*a*, 36*b* abut the top 34 as in FIG. 5, the hinge line 38 is at or slightly above the top surface of the handles. The bulk of the handles 36*a*, 36*b* are thus offset from the hinge line 38 about which they rotate. An offset about the diameter of the hinge-pin or slightly greater is believed suitable if the handles 36*a*, 36*b* have the same thickness measured along the axis 17 when the handles are in a plane orthogonal to that axis. The handles advantageously have the same basic shape except for the offset connection to the hinge 37. The handles 36*a*, 36*b* abut each other when rotated to the vertical position (FIG. 4) to form a single handle grippable by one hand with fingers interposed between the top 34 and handles 36. The handles 36*a*, 36*b* may have various shapes, but are preferably semicircular, each forming part of a circular ring encircling an outer periphery of the top 34 when they abut the top 34.

One handle, shown in FIGS. 4-5 as handle 36*a*, has a plug 40 that fits into a drink opening 42 in lid 30. The drink opening 42 is preferably located at an outer periphery of the upper surface 34 of top 34. Advantageously, the handles 32 and their hinge line are located so the plug 40 is at the apex of the semicircular handle 32*a*. The plug 40 is sized to provide a fluid tight fit with the drink opening 42. The opening 42 may be of circular, oblong, oblong with curved ends, elliptical, or slightly curved to conform to the periphery of the top where the opening 42 is located. The plug 44 conforms to the shape of opening 42, and is preferably slightly larger to form a slight interference fit to provide a removable, fluid tight seal. A ledge or protrusion 43 extending outward from the upper edge of the handle 36*a* at the location of the plug 40 but on the opposite side of the handle 36*a* may be provided to allow the user to more easily disengage the plug 40 from recess 42.

The lower end of the sidewall 32 of lid 30 has threads 24*b* on the inside or outside of the sidewall 32. In the depicted embodiment the threads 24*b* are external threads located and configured to releasably engage internal threads 24*a* on the connecting ring 18 and releasably fasten the lid 30 to the connecting ring 18 and container 12.

The lid's thread's 24*b* end at a short flange 44 extending toward or away from the centerline 17 depending on the location of the threads. The depicted embodiment has external threads 24*b* so the flange 44 extends outward. The flange 44 is located so it abuts the top of the connecting ring 18 to limit relative motion between the lid and the ring 18 and thus limit relative motion between the lid and the container 10. The threads 24 and abutting flange 44 and connecting ring 18 allow rotation of the lid to tighten the lid against the container 10.

A downwardly extending, drinking recess 46 may be formed in the upper surface 34 of the lid 30. The drinking recess 46 is located adjacent the drink opening 40 and is sized and configured to allow a user's upper lip to enter the recess 46 to make it easier to drink beverages passing through the drink opening 40. This recess 46 thus provides a lip groove on one side of the drinking outlet 40 imitating a cup's rim, such that the drinker's lip will not squeeze the water outlet and thus makes drinking more comfortable and convenient.

Advantageously, a slightly raised boss 48 on the upper surface 34 of lid 30 is provided and configured to snugly fit inside the periphery of the handles 36*a*, 36*b*. If the handles 36 are semi-circular then the boss 48 preferably has a circular periphery. The boss 48 helps prevent the handles from moving laterally in the plane of the top 34 when the handles abut the lid. Preferably, the boss 48 has a circular periphery located to snugly fit along the inner periphery of handle 36*b*. The boss 48 preferably only abuts a portion of the periphery of handle 36*a*, the portion adjacent hinge 37. The drinking recess 46 intersects the remaining portion of boss 48.

Gripping indentations 50 (FIG. 1) may optionally be provided on the outer surface of flange 44. The depicted indentations 50 are generally rectangular in shape for aesthetic design, and preferably alternating, slightly raised and slightly recessed areas—for aesthetic design.

Figure 3:
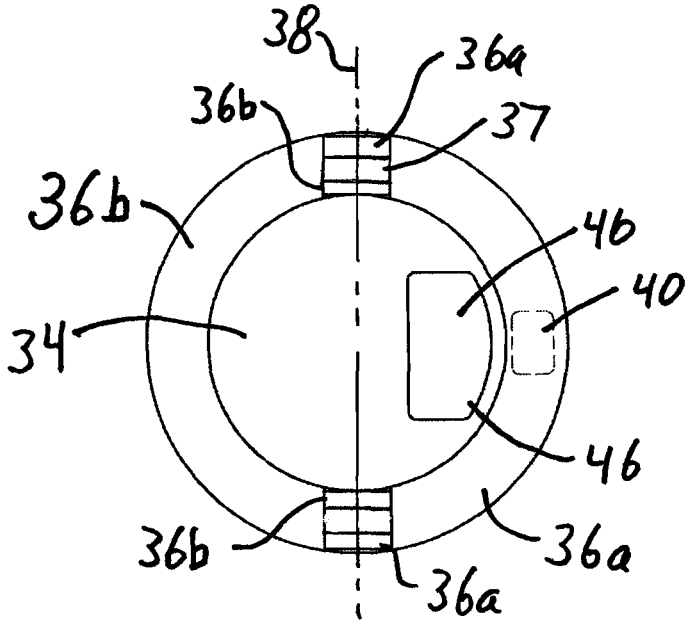
FIG. 3 is a top elevation view of the cup lid of FIGS. 1 and 2.

The handles 36*a*, 36*b* and the plug 40 are arranged at the top of the lid 30. Both handles 36*a*, 36*b* are connected to the lid 30 via the same hinge 37, such that the two semicircular handles 36*a*, 36*b* a ring when in the general plane of the top 34 of the lid 30, so the handles abut the top 34 as shown in FIG. 3. The semicircular handles 36*a*, 36*b* may be lifted and rotated an angle of 90° so the two handles 36*a*, 36*b* abut each other to form a single handle as shown in FIG. 4. The handle 36*a* with the plug 40 need not be used as a handle but may rotate about 180° so it rests against the handle 36*b* which in turn rests against the top 34 of lid 30. The semicircular length of handle 36*b* is thus offset from the hinge-line between opposing hinges 37 to allow this abutment. This offset is best seen in FIG. 5 where the hinge line is located at about the top surface of handles 36*a*, 36*b*. The plug-handle 36*a* has the plug 42 which fits into the drinking outlet 42 to block the outlet and optimally prevent leakage from the outlet 42. The outlet 42 is in fluid communication with the inside of the lid 30 and thus with the inside of the container 10 so that any liquid in the container can be poured out or drunk from outlet 42 without unscrewing and taking off the lid 30.

Each handle 36*a*, 36*b* may be used separately to carry the container 10 or the user may leave one or both handles flat against the lid and grab the sidewall 12 or other portion of the container or lid to carry the container. Since the handle 36*a* has plug 40 that can seal the drinking outlet 42, when the handle 36*a* is used to carry the container 10 either alone or in combination with handle 36*b*, the drinking opening is not sealed. Alternatively, the handle 36*a* and its plug 40 may be rotated parallel to top 34 and abutting and handle 36*b*, so the user can drink from opening 42, with neither handle being used to carry the container 10. Thus, the semicircular handles 36*a*, 36*b* may look alike, but one has an additional function provided by the plug 40. One handle may thus be referred to as the plug handle. It is believed possible that the opening 42 may comprises a plurality of adjacent openings rather than one single opening, with a plurality of mating plugs on handle 36*a*. Moreover, the plug 40 may be on handle 36*b* (rather than on 36*a*) and if so the opening 42 and plug 40 are located relative to each other so the plug 40 can seal the opening. It is believed preferably to have a single opening 42 and plug 40 in the periphery of the lid 30, at the top of the lid.

The material of the connecting ring 18, lid 30, handles 36, plug 40 may be the same as or different, and any or all may be the same as used with sidewall 12. Advantageously, the material is sufficiently heat resistant, acid-base and corrosion resistant, to be used as a beverage container for human use. A container 10 made of food grade metal or plastic is preferred. A container 10 of stainless steel and a lid 30 of plastic is believed suitable.

Referring to FIG. 5, in a further embodiment, the lid 30 has an interlayer chamber 50 located below a portion of top surface 34 of the lid. An access cover 52 is formed in the top 34 to releasably cover an opening in the top 34 that provides access to the chamber 50. The cover 52 is preferably releasably fastened to the top 34 and may be hinged to the lid 34 so as to rotate to allow access to chamber 50, or the cover 52 may be snap fit into position with projections on one end and a latch on the other end like many batter covers on electronic devices. Other releasable latching mechanisms may be used to releasably fasten cover 52 over the opening to chamber 50. The interlayer chamber 50 may be used for heat insulation, or it may be used for placing small articles, such as a small pack of instant coffee, sweeteners, sugar, or other condiments for use with the beverages to be placed in container 10.

Figure 9:
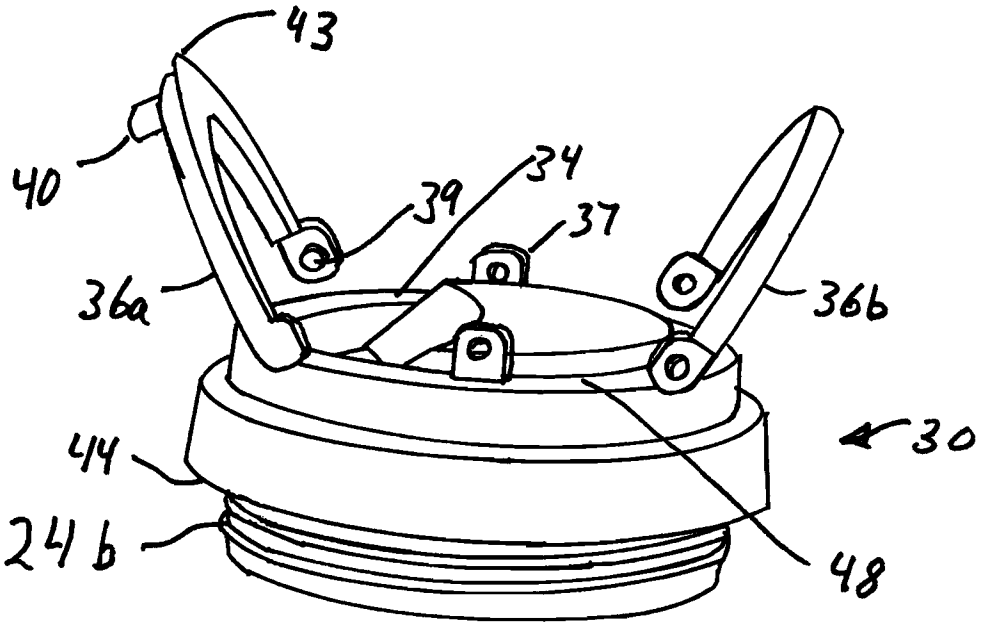
FIG. 9 is an exploded perspective view of the lid and handles.

Referring to FIGS. 6-9, the handles 36*a*, 36*b* are offset from hinge line 38. The exploded view of FIG. 9 shows opposing ends of each handle 36*a*, 36*b* fastening to opposing sides of a different hinge post 37. The rotating or pivoting connections can be achieved several ways, with a short pivot pin extending along axis 38, through the hinge post 37 and through the two mating ends of the handles 36*a*, 36*b* at each hinge post. But preferably, each opposing end of the handle 36*a* has a post 39 (FIG. 9) extending radially inward a distance sufficient to pass through the hinge post 37 and the adjacent end of handle 36*b*. A §similar post could be provided on the outward facing ends of the handle 36*b*. Advantageously, the pivot pin is staked, melted or otherwise deformed so it is not readily removed from engagement with the hinge post 37 and the other handle. The offset of the face of the handles 36*a*, 36*b* from the hinge line varies with the shape and thickness of the handles. The offset is preferably selected so that when the handles 36 are in a first position laying against the lid 30, the upward facing sides of the handles will face each other and abut each other when the handles are moved to a second position with the handles parallel to axis 17.

The container 10 may be of either a single-layer or a double-layer structure with heat insulation function. Advantageously, all parts of the container 10, lid 30 and connecting ring 18 may made of heat resistant and acid-base corrosion resistant food grade metal, plastic, glass or ceramic. The cup body can be of conical or cylindrical shape. Advantageously, the container 10 has sidewall 12 made of dual wall construction with a slight space between them to provide insulation. The lid 30 and handles 36 lend themselves to being made of suitably strong and food compliable plastic.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious, modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A portable beverage container and lid, comprising:

a container body having a sidewall with a closed bottom and an open top having a rim around the open top;

a connecting ring fastened to the container at the rim, the connecting ring having threads thereon and having a rim located to abut the rim on the container;

a lid having a lower portion with threads and configured to threadingly engage the threads on the connecting ring to releasably fasten the lid to the container, a flange at an upper end of the threads on the lid with the flange extending outward over the rim of the connecting ring, the lid having a top and a drink opening extending through the lid to provide fluid communication with the container body during use;

first and second handles rotatably connected to opposing sides of the lid to rotate about a common axis with each handle having an inner and outer periphery with the inner periphery being large enough so a person's fingers can be interposed between the handle and the lid during use to carry the container, the handles having a first position abutting the lid and a second position generally parallel to a longitudinal axis of the container and lid during use, the first handle having a plug thereon located and shaped to fit within the drink opening and plug that opening when the first handle is in the first position, wherein the lid has two hinge posts, one hinge post on each opposing side of the lid with a hinge line extending therebetween, and wherein each handle has opposing ends with each end offsetting the handle from the hinge line but rotating about the hinge line and connected to the hinge post, the first handle offset a distance sufficient to allow the first handle to rotate about 180° to rest against the second handle when the second handle is in the first position.

2. The beverage container of claim 1 wherein the handles have a top side facing along the longitudinal axis when the handles are in the first position, the top sides of the handles being generally parallel to the longitudinal axis when the handles are in the second position and abutting each other along a substantial portion of each handle.

3. The beverage container of claim 1, wherein each handle is semicircular in shape and extends over an arc of about 180 degrees and lays against the top of the lid in the first position.

4. The beverage container of claim 1, wherein the first position is orthogonal to the longitudinal axis and the drink opening is on the top.

5. The beverage container of claim 3, wherein the first position is orthogonal to the longitudinal axis and the drink opening is on the top.

6. The beverage container of claim 1, wherein the handles are semicircular in shape, with the ends of the first handle being on an outer side of each hinge post and the ends of the second handle being on the inner side of each hinge post.

7. The beverage container of claim 1, wherein the lid further comprises a drinking recess formed inward of the drinking opening and extending toward the container body and sized to accommodate a user's upper lip when drinking from the drinking opening.

8. The beverage container of claim 1, wherein the threads on the connecting ring are internal threads.

9. The beverage container of claim 1, further comprising an opening in the top of the lid having a releasable cover thereon, the opening providing access to a compartment formed on the underside of the top of the lid and having a compartment bottom that is not the container bottom.

10. The beverage container of claim 1, wherein the container body is a double wall, stainless steel construction with a space between the two walls to provide thermal insulation.

11. A portable beverage container and lid, comprising:

a container body having a sidewall with a closed bottom and an open top having a rim around the open top;

a connecting ring permanently fastened to the container at the rim, the connecting ring having internal threads thereon and having a rim located to abut the rim on the container;

a lid having a lower portion with external threads and configured to threadingly engage the threads on the connecting ring to releasably fasten the lid to the container, an outward extending flange at an upper end of the threads on the lid with the flange extending outward at the location of the rim of the connecting ring during use, the lid having a top with a drink opening therein to provide fluid communication with the container body during use;

first and second handles rotatably connected to two hinge posts, one on each opposing side of the lid so the handles rotate about a common axis of rotation but are offset from that common axis of rotation, each handle having an inner and outer periphery with the inner periphery being large enough so a person's fingers can be interposed between the handle and the lid during use to carry the container, the handles having a first position abutting the lid and a second position generally parallel to a longitudinal axis of the container during use, the first handle having a plug thereon located and shaped to fit within the drink opening and plug that opening when the first handle is in the first position, the first handle with the plug capable of rotating about 180° to rest against the other handle.

12. The beverage container of claim 11, wherein the handles have a top side facing along the longitudinal axis when the handles are in the first position, with the first position being orthogonal to the longitudinal axis, the top sides of the handles abutting each other along a substantial portion of the length of each handle in the second position.

13. The beverage container of claim 11, wherein each handle is semicircular in shape and extends over an arc of about 180 degrees, and further comprising a boss on the exterior surface of the lid having a semicircular periphery along one side of the boss, the boss shaped to conform to an inner periphery of one of the handles in the first position.

14. The beverage container of claim 11, wherein the lid further comprises a drinking recess formed inward of the drinking opening and extending toward the container body and sized to accommodate a user's upper lip when drinking from the drinking opening.

15. The beverage container of claim 11, further comprising an opening in the top of the lid having a releasable cover thereon, the opening providing access to a compartment formed on the underside of the top of the lid and having a compartment bottom that is not the container bottom.

16. A portable beverage container and lid, comprising:

a container body having a sidewall with a closed bottom and an open top having a rim around the open top;

a connecting ring fastened to the container at the rim, the connecting ring having threads thereon and having a rim located to abut the rim on the container;

a lid having a lower portion with threads and configured to threadingly engage the threads on the connecting ring to releasably fasten the lid to the container, an outwardly extending flange at an upper end of the threads on the lid with the flange extending above the rim of the connecting ring during use, the lid having a top and a drink opening extending through the lid to provide fluid communication with the container body during use;

first and second handles rotatably connected to opposing sides of the lid to rotate about a common axis, the handles having a first position abutting the lid and a second position generally parallel to a longitudinal axis of the container and lid during use, the first handle having a plug thereon located and shaped to fit within the drink opening and plug that opening when the first handle is in the first position, wherein the lid has two hinge posts on the common axis of rotation, one each on opposing side of the lid, and wherein the handles are semicircular in shape and each handle has opposing ends, with the ends of the first handle being on an outer side of each hinge post and the ends of the second handle being on an inner side of each hinge post, the first handle with the plug rotating about 180° to rest against the second handle when the second handle is in the first position.

17. A portable beverage container and lid, comprising:

a container body having a sidewall with a closed bottom and an open top having a rim around the open top;

a lid having a top and a depending skirt with threads thereon configured to engage mating threads at the open top of the container, the top of the lid having first and second handles rotatably connected to opposing sides of the lid to rotate about a common axis with each handle having an inner and outer periphery with the inner periphery being large enough so a person's fingers can be interposed between the handle and the lid during use to carry the container, the handles having a first position abutting the lid and a second position generally parallel to a longitudinal axis of the container and lid during use, the first handle having a plug thereon located and shaped to fit within a drink opening on an outer portion of the lid and plug that opening when the first handle is in the first position, wherein the lid has two hinge posts, one hinge post on each opposing side of the lid with a hinge line extending therebetween, and wherein each handle has opposing ends with each end offsetting the handle from the hinge line but rotating about the hinge line and connected to the hinge post, the first handle offset a distance sufficient to allow the first handle to rotate about 180° to rest against the second handle when the second handle in the first position.

18. A lid for a portable beverage container having a body with a closed bottom and an open top and threads around the open top, comprising:

a lid having a top and a depending skirt with threads thereon configured to engage mating threads at the open top of the container, the top of the lid having first and second handles rotatably connected to opposing sides of the lid to rotate about a common axis with each handle having an inner and outer periphery with the inner periphery being large enough so a person's fingers can be interposed between the handle and the lid during use to carry the container, the handles having a first position abutting the lid and a second position generally parallel to a longitudinal axis of the container and lid during use, the first handle having a plug thereon located and shaped to fit within a drink opening and plug that opening when the first handle is in the first position, wherein the lid has two hinge posts, one hinge post on each opposing side of the lid with a hinge line extending therebetween, and wherein each handle has opposing ends with each end offsetting the handle from the hinge line but rotating about the hinge line and connected to the hinge post, the first handle offset a distance sufficient to allow the first handle to rotate about 180° to rest against the second handle when the second handle in the first position.

* * * * *